US007744298B2

(12) United States Patent
Haas et al.

(10) Patent No.: US 7,744,298 B2
(45) Date of Patent: Jun. 29, 2010

(54) GELLED COMPOSITION APPLICATOR

(75) Inventors: Hans E. Haas, Stow, OH (US); Marcia Snyder, Stow, OH (US); Thomas M. Polatas, Munroe Falls, OH (US); Robert J. Harmacek, Aurora, OH (US)

(73) Assignee: Permatex, Inc., Solon, OH (US)

( * ) Notice: Subject to any disclaimer, the term of this patent is extended or adjusted under 35 U.S.C. 154(b) by 1208 days.

(21) Appl. No.: 10/966,260

(22) Filed: Oct. 15, 2004

(65) Prior Publication Data

US 2005/0105954 A1 May 19, 2005

Related U.S. Application Data

(60) Provisional application No. 60/511,810, filed on Oct. 16, 2003.

(51) Int. Cl.
*A46B 11/00* (2006.01)
*A46B 17/02* (2006.01)

(52) U.S. Cl. ..... 401/48; 401/266

(58) Field of Classification Search ..... 401/48, 401/266; 222/156, 189.09, 213
See application file for complete search history.

(56) References Cited

U.S. PATENT DOCUMENTS 4,828,419 A * 5/1989 Porter et al. ..... 401/126
5,074,440 A * 12/1991 Clements et al. ..... 222/189.09
5,577,851 A * 11/1996 Koptis ..... 401/266
5,996,796 A * 12/1999 Kvitrud et al. ..... 222/156
6,505,986 B1 * 1/2003 Oder ..... 222/213
6,523,720 B1 * 2/2003 Robbins, III ..... 222/153.05
2004/0237996 A1 12/2004 Fischer et al. ..... 132/320

FOREIGN PATENT DOCUMENTS

DE 19918587 A1 11/2000
DE 10114370 A1 10/2002
GB 2170696 A 8/1986

* cited by examiner

*Primary Examiner*—Tuan N Nguyen
(74) *Attorney, Agent, or Firm*—Avery N. Goldstein; Gifford, Krass, P.C.

(57) ABSTRACT

An adhesive composition applicator includes a housing having sidewalls and a neck that tapers to an opening. The housing encloses a gelled adhesive composition. The housing has a cross-sectional area and the opening has a cross-sectional area less than that of the housing cross-sectional area. A cap is provided that engages the housing. A mechanism is provided for urging the gelled composition material from the housing through the opening. The neck optionally also includes a shield to prevent gelled adhesive composition from running down the neck and provides a barrier against gelled adhesive smear reaching the point of intersection between the cap and the housing. To facilitate application of gelled composition to a point of application, a spatula is provided adjacent to the opening.

14 Claims, 1 Drawing Sheet

GELLED COMPOSITION APPLICATOR

RELATED APPLICATION

This application claims priority of U.S. Provisional Patent Application Ser. No. 60/511,810 filed Oct. 16, 2003, which is incorporated herein by reference.

FIELD OF THE INVENTION

The present invention generally relates to gelled composition applicators and in particular to gelled anaerobic curing composition applicators containing inorganic thickeners that are well suited in the thread locking setting.

BACKGROUND OF THE INVENTION

Historically, thread lockers have been liquids of varying viscosity. These liquids have met with limited acceptability owing to handling properties. Liquid thread lockers tend to be difficult to apply in overhead settings and are generally considered to be imprecise owing to drippage from the cap running down the exterior of the primary package and seepage of the material to places where locking is deemed undesirable. As a result of these handling properties, a conventional liquid thread locker typically requires a secondary package to prevent leakage onto surrounding tools or apparel.

Various attempts have been made in the prior art to add various waxes, polymers, and organic species to a liquid thread locker composition in order to address these limitations. Representative of these attempts are U.S. Pat. Nos. 3,547,851; 4,497,916 and 6,451,927. In particular, U.S. Pat. No. 6,451,927 B1 utilizes an organically thickened anaerobic composition provided in a lipstick-type applicator. While this thickened composition is effective in allowing overhead thread locker application and the prevention of drippage, the method of application of wiping a bolt across a raised applicator face tends to smear thread locker composition onto the outer surfaces of the applicator so as to require applicator wiping prior to cap replacement. Additionally, under compressive forces, liquid and conventionally thickened thread locker compositions tend to be forced from the site where adhesive bonding is actually required. Thus, there exists a need for a gelled anaerobic composition that is provided in a readily resealable applicator where the gelled anaerobic composition is delivered with greater precision.

SUMMARY OF THE INVENTION

An adhesive composition applicator includes a housing having sidewalls and a neck that tapers to an opening. The housing encloses a gelled adhesive composition. The housing has a cross-sectional area and the opening has a cross-sectional area less than that of the housing cross-sectional area. A cap is provided that engages the housing. A mechanism is provided for urging the gelled composition material from the housing through the opening. The neck optionally also includes a shield to prevent gelled adhesive composition from running down the neck and provides a barrier against gelled adhesive smear reaching the point of intersection between the cap and the housing.

To facilitate application of gelled composition to a point of application, a spatula is provided adjacent to the opening.

DETAILED DESCRIPTION OF THE PREFERRED EMBODIMENTS

While the present invention is detailed herein with respect to gelled anaerobic compositions packaged in a stick form, it is appreciated that an applicator according to the present invention is likewise operative with compositions illustratively including epoxies, acrylics, olefinics, and combinations thereof. Further, it is recognized that a liquid curable component or one dissolved in a suitable solvent is amenable to thickening and packaging according to the present invention. A thickener is mixed therewith in a sufficient quantity to create a gelled composition suitable for packaging in an applicator.

Figure 1:
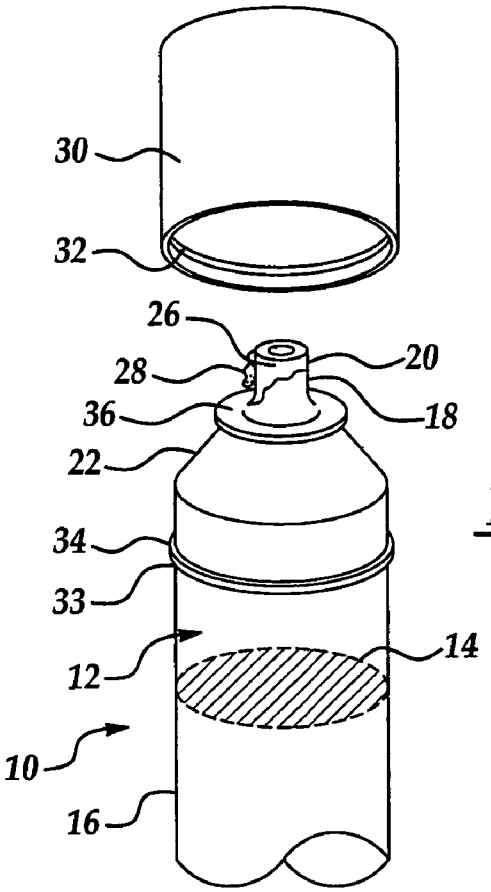
FIG. 1 is a perspective view of an applicator according to the present invention.

Referring now to FIG. 1, an adhesive composition applicator is shown generally at 10. The applicator 10 includes a housing 12 that is characterized by a housing cross-sectional area 14. The housing cross-sectional area 14 being bounded by a sidewall 16. The housing 12 terminates in an opening 18 that is characterized by an opening cross-sectional area 20. A neck 22 is intermediate between the opening 18 and the sidewall 16. The opening cross-sectional area 20 according to the present invention is less than 90% of the housing cross-sectional area. Preferably, the opening cross-sectional area is less than 70% of the housing cross-sectional area. More preferably, the opening cross-sectional area is between 2 and 40% of the housing cross-sectional area. Most preferably, the opening cross-sectional area is between 2 and 10% of the housing cross-sectional area. It is appreciated that the length of the neck 22 and therefore the degree of taper therein is a matter of design choice based on variables including adhesive composition viscosity, extrusion force, and applicator construction material properties.

While the thickness and materials from which a sidewall 16 and other housing components are produced is in part dictated by the forces exerted by the extrusion mechanism, an inventive housing is illustratively formed from materials such as plastics, metal, glass, ceramic and combinations thereof. Preferably, a housing 12 according to the present invention is formed of an injection moldable thermoplastic material.

While the housing of FIG. 1 is depicted having a circular housing cross section and a circular opening cross section, it is appreciated that any number of cross-sectional shapes are operative for the housing and opening within an applicator according to the present invention. These various cross-sectional shapes for an inventive applicator illustratively include oval, elliptical, rectilinear, polygonal and more complex forms.

A mechanism (not shown) is provided for urging a gelled adhesive composition 26 from the housing 12 and through the opening 18. The gelled adhesive composition 26 exits the opening 18 as a column having the cross-sectional shape and dimension corresponding to the opening cross-sectional area 20. The gelled adhesive composition 26 in usage is brought into contact with a substrate to be adhesively secured such as a threaded fastener (not shown). Through contact with a substrate, gelled adhesive composition 26 is deformed and invariably creates composition residue as depicted at 28 on the neck portion 22. The mechanism by which gelled adhesive composition 26 is urged from the housing 12 is that conventional to the art and illustratively includes a screw mechanism that converts rotation of a base into lateral movement of a plunger within the housing 12; additionally, a plunger is also an illustrative mechanism operative in the context of the present invention.

A cap 30 is adapted to selectively engage the housing 12 in the vicinity of the base 32 of the neck 22. The cap 30 selectively secures to the housing 12 through a variety of conventional mechanisms illustratively including complementary threads, friction fit, a Luer-type coupling. Preferably, the cap 30 friction fits to the housing 12. More preferably, the cap 30 has a catch 32 complementary to a corresponding neck ridge 34 proximal to the neck base 33. The cap 30 is typically formed of materials used to form the housing 12. Preferably, the cap 30 is formed of an injection moldable thermoplastic material.

Optionally, intermediate between the neck base 33 and the opening 18, the neck 22 includes a shield 36. The shield 36, if present, is sized such that the cap 30 engages the neck base 33.

In operation, an inventive applicator 12 by having an opening 18 with a smaller cross-sectional area 20 than that of the housing 14 in which a gelled adhesive is stored allows for gelled adhesive residue 28 that collects on the neck 22 to avoid displacement when the cap 30 is placed thereover. Additionally, gelled adhesive residue 28 is readily applied to an adhesive substrate directly from the neck 22 thereby making more efficient use of the gelled adhesive composition content. In contrast to the prior art, placement of a cap does not displace gelled adhesive residue to a location external to the housing 12 where the adhesive can contaminate user skin or other proximal surfaces. In instances where the neck includes an additional shield 36, an added barrier is provided against gelled adhesive debris reaching the point of intersection between a cap 30 and an adhesive housing 12.

Figure 2:
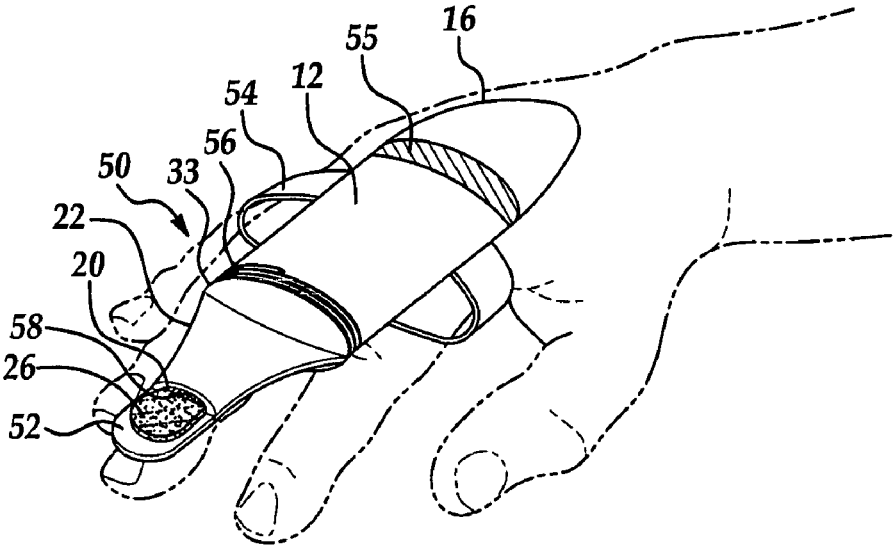
FIG. 2 is a perspective view of another embodiment of an inventive applicator according to the present invention adapted to mount on a user hand.

Referring now to FIG. 2, an alternate embodiment of an inventive adhesive composition applicator is shown generally at 50 where like numbers have the meaning provided with respect to FIG. 1. The applicator 50 has a spatula 52 onto which adhesive composition 26 is extruded. Spatula 52 serves as an application surface to be brought into contact with a substrate to be adhesively secured such as a threaded fastener. The applicator 50 is shown with an elliptical opening cross-sectional area 58 and a crescent-shaped housing cross-sectional area 55. The applicator 50 optionally includes a strap 54 adapted to secure to the back of a user hand (shown in ghost). Through the use of the strap 54, a gelled adhesive composition 26 is urged from the housing 12 through lateral compressive forces on the housing 12. The embodiment depicted in FIG. 2 at 50 affords application of gelled adhesive composition while a user's hands are otherwise occupied. In this embodiment, the housing cross-sectional shape changes along the length thereof and becomes circular proximal to the neck 33. Threads 56 are integral with the exterior of sidewall 16 proximal to the neck 33. The threads 56 are complementary to threads on a complementary cap (not shown).

In operation, a curable gelled adhesive composition according to the present invention is formed from a variety of polymerizable monomers alone or in solvated form. The identity of the solvent is largely dictated by the solubility characteristics of the polymerizable monomer and compatibility of that solvent with the other chemical reactants. Solvents operative herein illustratively include: water, $C_2$-$C_{20}$ linear or branched alkanes; ethers; esters; alcohols; ketones; aldehydes; acids; $C_6$-$C_{10}$ aromatics and substituted aromatics; furans; and chlorinated, brominated, and fluorinated forms thereof; plasticizers; oils, such as dioctyl phthalate (DOP); and liquid resins such as triethylene glycol dimethacrylate (triEGMA) and polyethylene glycol dimethacrylate (PEGMA).

The identity of the polymerizable monomer operative in the present invention includes those detailed in U.S. patent application Publication 2002/0111439, which is incorporated herein by reference.

In addition to the polymerizable monomer, alone or in solvated form, a gelled composition preferably includes an inorganic thickener. Inorganic thickeners operative herein illustratively include silica in fumed or colloidal states; graphite particulate, turbostratic carbon, carbon fiber, carbon nanotubes, fullerenes; clay, diatomaceous earth; boric acid; and combinations thereof. An inorganic thickener is typically present from 5 to 50 total weight percent of the gelled adhesive composition. It is appreciated that the specific amount of inorganic thickener needed is dependent upon variables illustratively including polymerizable monomer viscosity, alone or in solvated state; thickener surface area; thickener hydrophobicity; and resulting adhesive joint strength. Preferably, the inorganic thickener is fumed silica present from 2 to 20 total weight percent of the gelled adhesive composition. A commercially available form of fumed silica operative herein is CAB-O-SIL M5 (Cabot Corp., Tuscola, Ill.).

In addition to an inorganic thickener, an inventive gelled adhesive composition optionally includes a rheological additive to further modify the viscosity of the gelled adhesive composition. Rheological additives compatible with polymerizable monomers and the inorganic thickeners detailed herein are well known to the art. Rheological additives operative herein illustratively include diols, triols, diacids, triacids, diamides and triamides, polyhydroxy carboxylic acid amides, and combinations thereof. Preferably, the rheological additive is a polyhydroxy carboxylic acid amide. A polyhydroxy carboxylic acid amide operative herein is commercially available under the registered trademark BYK-R 605 (BYK-Chemie, Bad Homburg, Germany).

In addition to the above-stated components, it is appreciated that an inventive gelled adhesive composition typically includes one or more components illustratively including copolymers, mixtures of polymerizable monomers, polymerization initiators, stabilizers, accelerators, colorants, plasticizers, pigments, fillers, fluorescent agents, and other substances conventional to the art and in conventional quantities. Representative examples of such substances are again found in U.S. patent application Publication 2002/0111439, which is incorporated herein by reference.

It will be apparent to one skilled in the art to which the invention pertains that various modifications are readily made upon reading the instant specification where these modifications do not depart from the spirit of the invention. These modifications and all equivalents thereof are intended to be encompassed within the appended claims.

The invention claimed is:

1. An adhesive composition applicator comprising:

a housing having a housing cross-sectional area, sidewalls, a neck that tapers to an opening, and a neck base, said housing enclosing a gelled adhesive composition, the opening in said housing defining an opening cross-sectional area that is less than the housing cross-sectional area;

a cap engaging said housing on the neck base and independent of said neck; and a mechanism for urging said gelled adhesive composition from said housing through the opening.

2. The applicator of claim 1 wherein said housing has a cylindrical housing cross-sectional area.

3. The applicator of claim 1 wherein said housing is a thermoplastic.

4. The applicator of claim 1 wherein the opening cross-sectional area is less than 90% of the housing cross-sectional area.

5. The applicator of claim 1 wherein the opening cross-sectional area is less than 70% of the housing cross-sectional area.

6. The applicator of claim 1 wherein the opening cross-sectional area is between 2 and 40% of the housing cross-sectional area.

7. The applicator of claim 1 wherein the neck tapers parallel to said sidewalls proximal to the opening.

8. The applicator of claim 1 wherein said cap friction fits to said housing.

9. The applicator of claim 8 wherein said cap has a catch complementary to a ridge extending from said housing.

10. The applicator of claim 3 wherein said housing further comprises a shield located on the neck.

11. An adhesive composition applicator comprising:

a housing having a housing cross-sectional area, sidewalls, a neck that tapers to an opening, and a neck base, said housing enclosing gelled adhesive composition, the opening in said housing defining an opening cross-sectional area that is less than the housing cross-sectional area;

a cap engaging said housing on the neck base and independent of said neck; and a mechanism for urging said gelled adhesive composition from said housing through the opening; wherein said housing further comprises a shield located on the neck.

12. The applicator of claim 11 wherein said housing has a cylindrical housing cross-sectional area.

13. The applicator of claim 11 wherein said housing is a thermoplastic.

14. The applicator of claim 11 wherein the neck tapers parallel to said sidewalls proximal to the opening.

* * * * *